US010524517B2

(12) United States Patent
Qiu

(10) Patent No.: US 10,524,517 B2
(45) **Date of Patent: *Jan. 7, 2020**

(54) ATOMIZER AND ELECTRONIC CIGARETTE

(71) Applicant: JOYETECH EUROPE HOLDING GMBH, Zug (CH)

(72) Inventor: Wei-Hua Qiu, ChangZhou (CN)

(73) Assignee: JOYETECH EUROPE HOLDING GMBH, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/411,420

(22) Filed: May 14, 2019

(65) Prior Publication Data

US 2019/0261695 A1 Aug. 29, 2019

Related U.S. Application Data

(60) Division of application No. 16/011,659, filed on Jun. 19, 2018, which is a continuation-in-part of application No. 15/952,527, filed on Apr. 4, 2018, now Pat. No. 10,292,435, which is a continuation-in-part of application No. 15/393,139, filed on Dec. 28, 2016, now Pat. No. 9,974,117.

(30) Foreign Application Priority Data

Jun. 8, 2016 (CN) ..... 2016 1 0405471
May 31, 2018 (CN) ..... 2018 2 0836524 U
May 31, 2018 (CN) ..... 2018 2 0836525 U

(51) Int. Cl.
*A24F 47/00* (2006.01)

(52) U.S. Cl.
CPC ..... *A24F 47/008* (2013.01)

(58) Field of Classification Search
CPC .. H05B 1/0244; H05B 2203/021; H05B 6/44; H05B 6/108; H05B 6/365; A24F 47/008; H02J 7/025; H02J 7/0072; H02J 50/10
USPC ..... 131/329, 194, 270, 273
See application file for complete search history.

(56) References Cited

U.S. PATENT DOCUMENTS 5,269,327 A * 12/1993 Counts ..... A24F 47/008 128/200.14
5,613,505 A * 3/1997 Campbell ..... A24F 47/008 128/202.21
8,864,909 B2 * 10/2014 Mishra ..... A24B 15/283 131/275
8,881,737 B2 * 11/2014 Collett ..... H05B 3/265 131/273
9,974,117 B2 * 5/2018 Qiu ..... H05B 1/0244
(Continued)

*Primary Examiner* — Edwin A. Leon
(74) *Attorney, Agent, or Firm* — ScienBiziP, P.C.

(57) ABSTRACT

An atomizer includes a storage member and a cigarette holder. An inductive chamber and an airflow passage are positioned in the storage member. An air suction port is defined on the cigarette holder. The cigarette holder is movably sleeved on an end of the storage member. The cigarette holder can be in a locked state or in an unlocked state with respect to the storage member by moving the cigarette holder. When the cigarette holder is in the locked state, at least one of the inductive chamber and the airflow passage is closed by the cigarette holder. When the cigarette holder is in the unlocked state, the air suction port communicates with both the inductive chamber and the airflow passage.

18 Claims, 13 Drawing Sheets

(56) References Cited

U.S. PATENT DOCUMENTS

| | | | | |
|---|---|---|---|---|
| 10,004,272 | B2 * | 6/2018 | Li | A61M 11/042 |
| 2016/0057811 | A1 * | 2/2016 | Alarcon | A24F 47/008 219/494 |
| 2016/0374400 | A1 * | 12/2016 | Monsees | A61M 15/06 131/329 |
| 2017/0079330 | A1 | 3/2017 | Mironov et al. | |
| 2018/0042299 | A1 | 2/2018 | Han et al. | |
| 2018/0077970 | A1 | 3/2018 | Worm et al. | |

* cited by examiner

ATOMIZER AND ELECTRONIC CIGARETTE

CROSS-REFERENCE TO RELATED APPLICATIONS

The subject matter herein generally relates to electronic cigarettes. This application is a divisional application of U.S. patent application with Ser. No. 16/011,659, filed on Jun. 19, 2018, which claims priority to CN Patent Application with Serial Number 201610405471.X, filed on Jun. 8, 2016, the disclosure of which is incorporated herein by reference.

FIELD

The present disclosure relates to smoking simulator, and more particularly to an atomizer and an electronic cigarette.

BACKGROUND

A conventional electronic cigarette automatically controls the opening and closing of the electronic cigarette by detecting the suction action of a user, by a sensor arranged in an airflow passage adjacent to an air inlet. However, since the heating member is also located in the airflow passage, and the sensor is located between the heating member and the air inlet, the suction of the user is hindered by the heating member, and thus a greater suction force is needed to allow the airflow in the airflow passage cause air pressure for the detection by the sensor. On the other hand, since the heating member is in liquid communication with a smoke liquid storage member, the smoke liquid in the smoke liquid storage member may leak into the airflow passage through the heating member, and leaked smoke liquid may block the air inlet. Therefore, the air outside of the electronic cigarette may be blocked from entering into the airflow passage, thus affecting the detection by the sensor. Additionally, the leaked smoke liquid may enter into the sensor, which would cause the sensor to short-circuit. In addition, there may be residual smoke in the airflow passage that can cause the airflow passage to be humid. The sensor over a long period under such environment may affect its service life.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
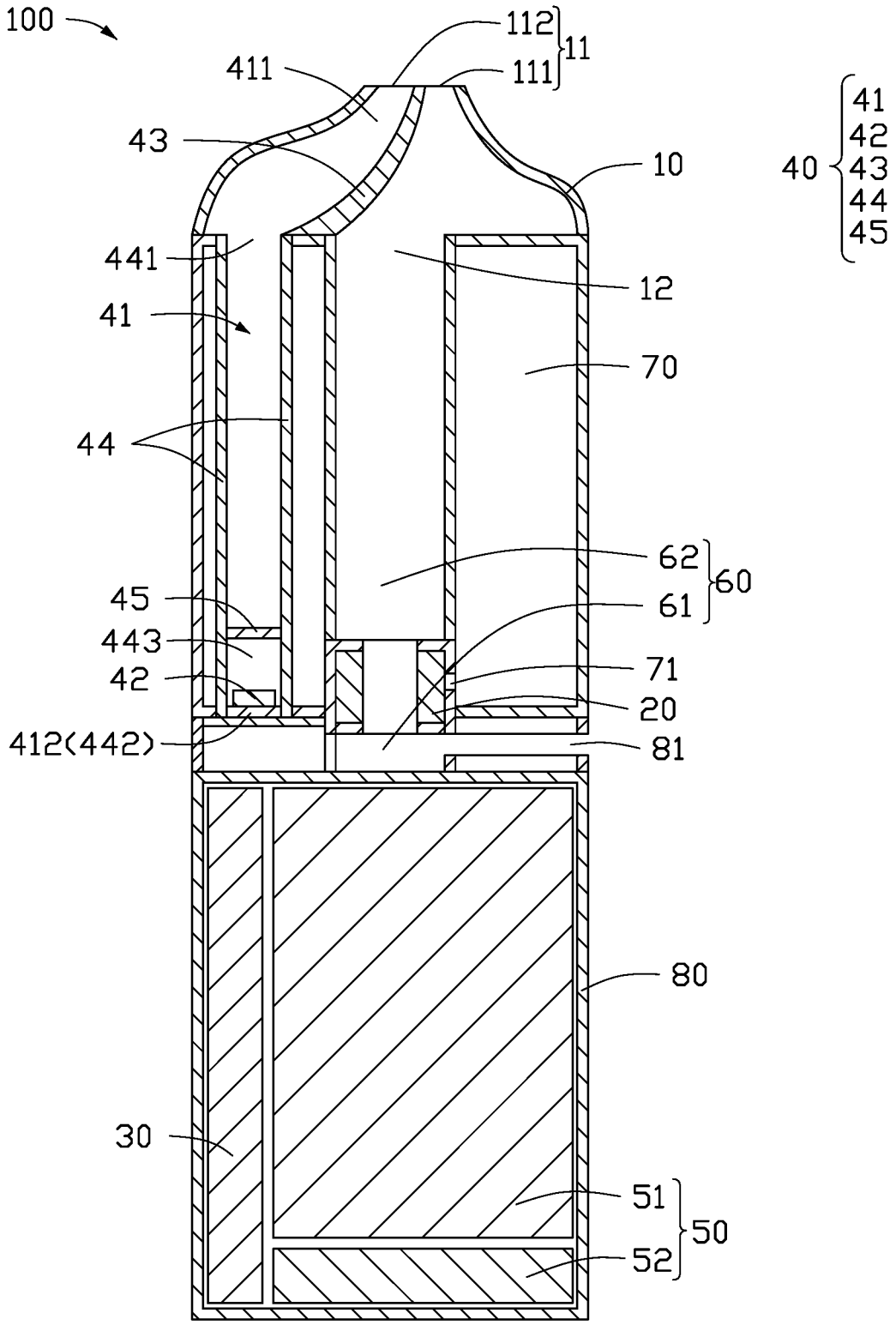
FIG. 1 is a cross-sectional view of an electronic cigarette in one mode according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection may be such that the objects are permanently connected or releasably connected. The term "outside" refers to a region that is beyond the outermost confines of a physical object. The term "substantially" is defined to be essentially conforming to the particular dimension, shape, or other feature that the term modifies, such that the component need have that exact feature. The term "comprising," when utilized, means "including, but not necessarily limited to"; it specifically indicates open-ended inclusion or membership in the so-described combination, group, series and the like.

The terms "first", "second" and other terms in the present disclosure are only used as textual symbols as the circumstances may require, but such a practice of ordination is not limited to using only these terms. It should be further noted that these terms can be used interchangeably.

Referring to FIG. 1, in a first embodiment, an electronic cigarette 100 includes a cigarette holder 10, a heating member 20, a controller 30, a sensor assembly 40, and a battery assembly 50. The cigarette holder 10 has an air suction port 11 in air communication with the air outside of the electronic cigarette 100. The sensor assembly 40 includes an inductive chamber 41 and a sensor 42 arranged in the inductive chamber 41. The heating member 20 and the battery assembly 50 are electrically connected with the controller 30, and the sensor 42 is connected with the controller 30 through signals. The heating member 20 is arranged outside of the inductive chamber 41. The inductive chamber 41 has two ends, one end of the inductive chamber 41 is a first open end 411, and the other end of the inductive chamber 41 is a first sealed end 412. The first open end 411 of the inductive chamber 41 is in air communication with the air suction port 11.

When a user inhales through the air suction port 11, at least part of air within the inductive chamber 41 is sucked out. Air pressure in the inductive chamber 41 decreases, thus the sensor 42 may detect the change of the pressure, generate a trigger signal, and send the trigger signal to the controller 30. The controller 30 receives the trigger signal, and controls the battery assembly 50 to supply electrical power to the heating member 20.

When the user stops inhaling through the air suction port 11, the inductive chamber 41 is in air communication with the air outside of the electronic cigarette 100 by the air suction port 11, to restore the air pressure in the inductive chamber 41. Thus, the sensor 42 may sense the restored air pressure, and generate a shutdown signal and transmit the shutdown signal to the controller 30. The controller 30 receives the shutdown signal, and controls the battery assembly 50 to stop supplying electrical power to the heating member 20.

The sensor assembly 40 includes a splitter plate 43 and a shutoff piece 44. The splitter plate 43 is arranged in the cigarette holder 10. The shutoff piece 44 is located at one end of the cigarette holder 10 opposite to the air suction port 11, and the shutoff piece 44 is coupled to the splitter plate 43 and an inner wall of one side of the cigarette holder 10. Thus, the inner wall of one side of the cigarette holder 10, one side of the splitter plate 43, and the shutoff piece 44 together form the inductive chamber 41. An inner wall of the other side of the cigarette holder 10 and the other side of the splitter plate 43 together form a connection port 12. The connection port 12 is in air communication with the air suction port 11.

In one mode, the shutoff piece 44 is a shutoff tube. The shutoff tube has two ends. On end of the shutoff tube is a second open end 441, the other end of the shutoff tube is a sealed end 442. The second open end 441 of the shutoff tube is coupled to the splitter plate 43 and one side of the inner wall of the cigarette holder 10, respectively, and the second open end 441 of the shutoff tube is located at one end of the cigarette holder 10 opposite to the air suction port 11. The second sealed end 442 of the shutoff tube is the first sealed end 412 of the inductive chamber 41. The shutoff tube has an inner chamber 443. The inner chamber 443 of the shutoff tube is also a part of the inductive chamber 41. The sensor 42 may be arranged in the inner chamber 443 of the shutoff tube, so a location of the sensor 42 may be changed according to a suitable size and/or shape of the shutoff tube. In the embodiment, the second sealed end 442 of the shutoff tube is arranged adjacent to the controller 30. The sensor 42 is arranged in the inner chamber 443 of the shutoff tube, and located at the second sealed end 442 of the shutoff tube, thus facilitating the electrical connection of the sensor 42 with the controller 30.

Figure 2:
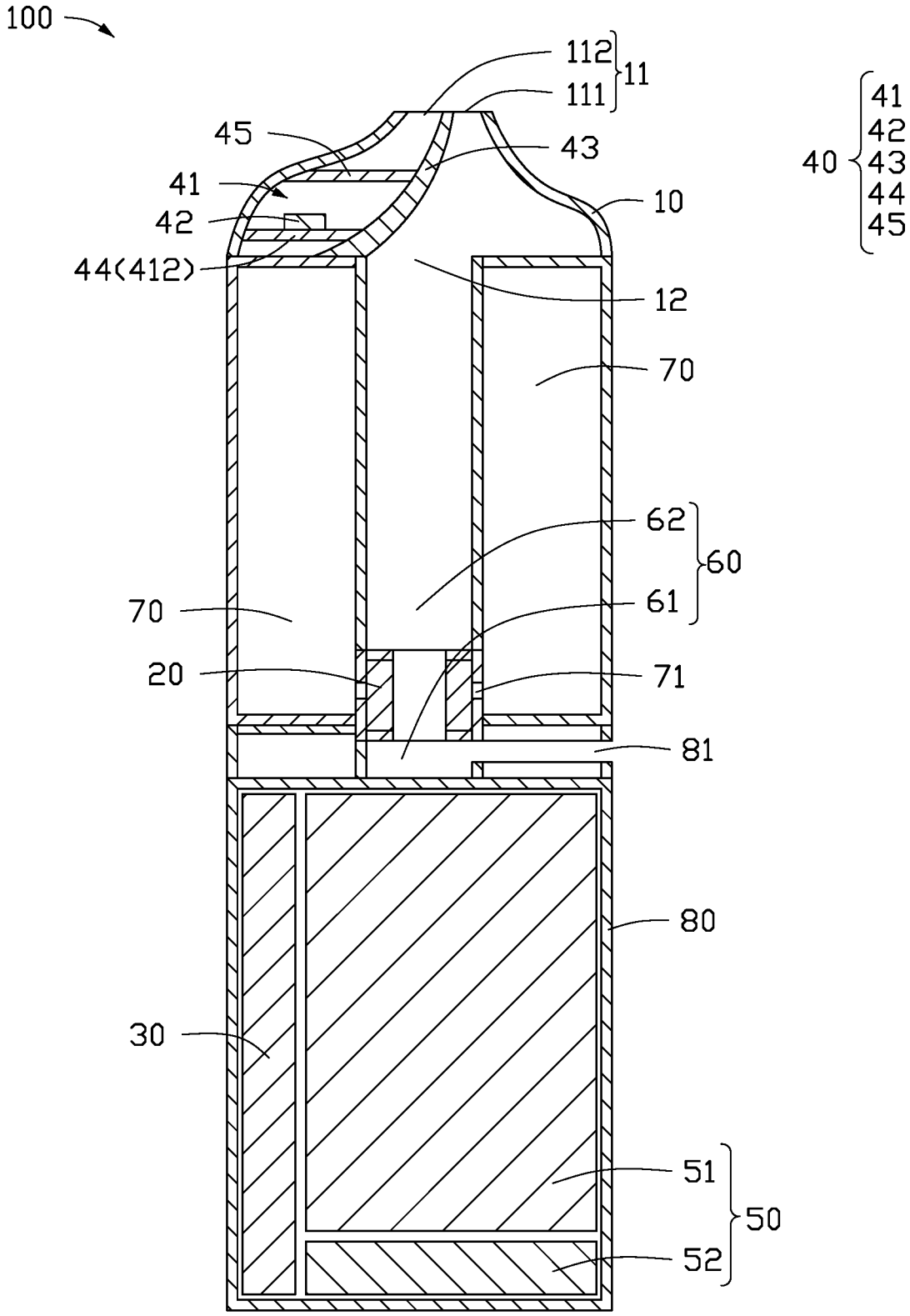
FIG. 2 is a cross-sectional view of the electronic cigarette according to the first embodiment in another mode.

Referring to FIG. 2, in another mode, the shutoff piece 44 is a shutoff plate. The shutoff plate is coupled to the splitter plate 43 and one side of the inner wall of the cigarette holder 10, respectively. The shutoff plate is located at one end of the cigarette holder 10 opposite to the air suction port 11. The shutoff plate is the first sealed end 412 of the inductive chamber 41. By using the shutoff plate, a size of the inductive chamber 41 can be reduced, thus space within the electronic cigarette 100 can be saved. The saved space can be used to store the smoke liquid. The sensor 42 is adjacent to the air suction port 11 by using the shutoff plate, thus facilitating the accuracy of the sensor 42 when detecting inhalations of the user.

In other embodiments, at least one of the splitter plate 43 and the shutoff piece 44 may be integrally formed with the cigarette holder 10.

Referring again to FIG. 1, one end of the splitter plate 43 adjacent to the air suction port 11 extends into the air suction port 11, to divide the air suction port 11 into a first air suction port 111 and a second air suction port 112. The first air suction port 111 and the second air suction port 112 are isolated from each other. The first air suction port 111 is in air communication with the connection port 12, and the second air suction port 112 is in air communication with the inductive chamber 41. The smoke created in the electronic cigarette 100 flows from the connection port 12 to the first air suction port 111, and the air in the inductive chamber 41 is sucked out by the second air suction port 112, which may prevent the smoke entering into the inductive chamber 41 through a connection (not shown) among the connection port 12, the inductive chamber 41, and the air suction port 11, render the air pressure in the inductive chamber 41 more reliable and prevent detection interference to the sensor 42.

Furthermore, the sensor assembly 40 further includes a film 45 arranged in the inductive chamber 41 and located above the sensor 41. The film 45 may be impermeable and deformable. The arrangement of the film 45 can prevent contamination from the air suction port 11 or the second air suction port 112 from entering into the inductive chamber 41 and polluting the sensor 42, thereby affecting the sensitivity of the sensor 42. When the user inhales through the air suction port 11 or the second air suction port 112, the air within in the inductive chamber 41 and located above the film 45 is at least partially sucked out from the air suction port 11 or the second air suction port 112. Thus, the film 45 is raised upward toward the air suction port 11 or the second air suction port 112, and a space formed between the film 45 and one end of the shutoff piece 44 adjacent to the sensor 42 in the inductive chamber 41 increases, thus reducing air pressure in the space below the film 45 within the inductive chamber 41. The sensor 42 may sense the pressure change, generate the trigger signal, and send the trigger signal to the controller 30. The controller 30 receives the trigger signal, and controls the battery assembly 50 to supply an electrical power to the heating member 20. When the user stops inhaling from the air suction port 11 or the second air suction port 112, the space above the film 45 within the inductive chamber 41 is in air communication with the air outside through the air suction port 11 or the second air suction port 112, and allows the air pressure to be restored. Thus, a deformation of the film 45 is restored, and the pressure in the space below the film 45 within the inductive chamber 41 is restored. The sensor 42 may sense the restored air pressure, and generate the shutdown signal to the controller 30. The controller 30 receives the shutdown signal, and controls the battery assembly 50 to stop supplying the electrical power to the heating member 20.

The battery assembly 50 includes a battery module 51 and a charging module 52. The controller 30 and the charging module 52 are electrically connected with the battery module 51. The battery module 51 is configured to supply the electric power to the heating member 20 under the control of the controller 30. The charging module 52 is configured to couple to an external power source, to allow the external power source to charge the battery module 51.

The electronic cigarette 100 further includes an airflow passage 60, a storage member 70, and a housing 80. The airflow passage 60 is isolated from the inductive chamber 41. The storage member 70 is configured to store the smoke liquid. One end of the cigarette holder 10 opposite to the air suction port 11 is coupled to the housing 80. The heating member 20, the controller 30, the battery assembly 50, the airflow passage 60, and the storage member 70 are received in the housing 80. In one embodiment, the sensor assembly 40 is received in the cigarette holder 10. In another embodiment, one part of the sensor assembly 40 is received in the cigarette holder 10, the other part of the sensor assembly 40 is received in the housing 80. The housing 80 defines an air inlet 81. The airflow passage 60 is in air communication with the connection port 12 and the air inlet 81. The heating member 20 is arranged in the airflow passage 60 and is in liquid communication with the storage member 70. A wall of the storage member 70 defines a liquid inlet hole 71 aligned with the heating member 20. The smoke liquid stored in the storage member 70 flows to the heating member 20 through the liquid inlet hole 71. When the battery module 51 supplies the electric power to the heating member 20, the heating member 20 heats the smoke liquid to form smoke. Air flows into the airflow passage 60 through the air inlet 81, flows through the heating member 20 and mixes with the smoke, then flows to the connection port 12, and finally flows out from the air suction port 11 or the first air suction port 111 when inhaled.

In the present embodiment, the airflow passage 60 is substantially L-shaped. The airflow passage 60 includes an air inlet part 61 and a smoke outlet part 62. The smoke outlet part 62 is arranged along an axial and lengthways direction of the electronic cigarette 100 and the air inlet part 61 is arranged along a direction extending radially from the center line of the axial direction of the electronic cigarette 100. The heating member 20 is a hollow and open-ended structure. The hollow structure allows communication between the air inlet part 61 and the smoke outlet part 62. One end of the air inlet part 61 opposite to the smoke outlet part 62 is in air communication with the air inlet 81. One end of the smoke outlet part 62 opposite to the air inlet part 61 is in air communication with the connection port 12.

Figure 3:
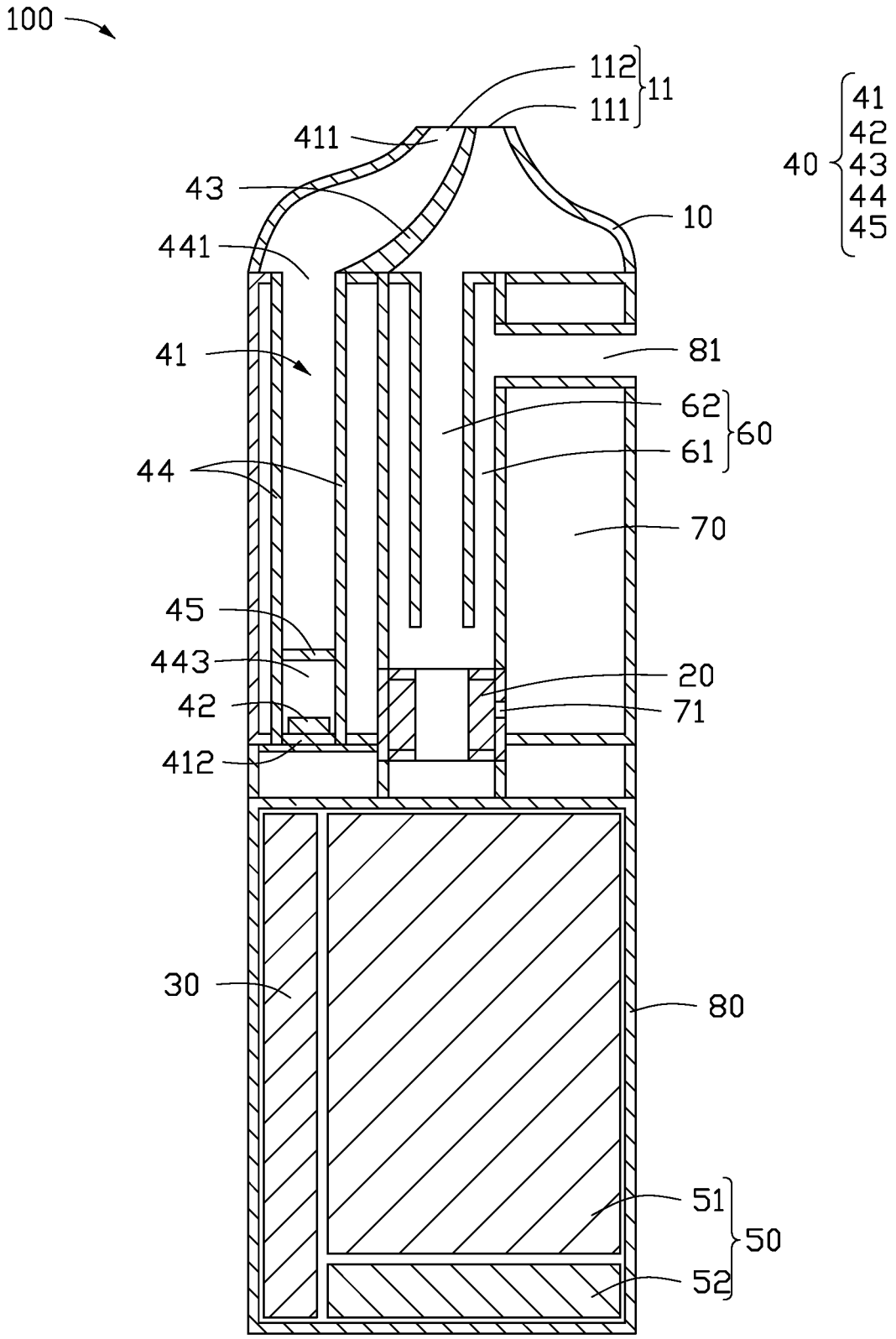
FIG. 3 is a cross-sectional view of yet another mode of the electronic cigarette according to the first embodiment.

Referring to FIG. 3, in another mode, the airflow passage 60 includes an air inlet part 61 and a smoke outlet part 62. The air inlet part 61 is arranged along the axial direction of the electronic cigarette 100. The smoke outlet part 62 is arranged along the axial direction of the electronic cigarette 100 and fitted within the air inlet part 61. An upper end of the air inlet part 61 is in air communication with the air inlet 81, and a lower end of the air inlet part 61 is connected to the heating member 20. An upper end of the smoke outlet part 62 is in air communication with the connection port 12, and a lower end of the smoke outlet part 62 is distanced from the heating member 20 for the air inlet part 61 in air communication with the smoke outlet part 62.

In the present mode, the inductive chamber 41 has two ends. One end of the inductive chamber 41 is a first open end 411, the other end of the inductive chamber 41 is a first sealed end 412. The open end of the inductive chamber 41 is in air communication with the air suction port 11. The sensor 42 is arranged in the inductive chamber 41, and the heating member 20 is arranged outside of the inductive chamber 41, to allow the suction action of the user directly act on the sensor 42 without obstruction by the heating member 20. On the other hand, the inductive chamber 41 is isolated from the airflow passage 60, thus the detection of the sensor 42 is not affected by the leaked smoke liquid which blocks the air inlet 81. Since a humid environment in the inductive chamber 41 is avoided, service life of this device is extended. The likelihood of short-circuited of the sensor 42 caused by the leakage of the smoke liquid is also reduced.

Figure 4:
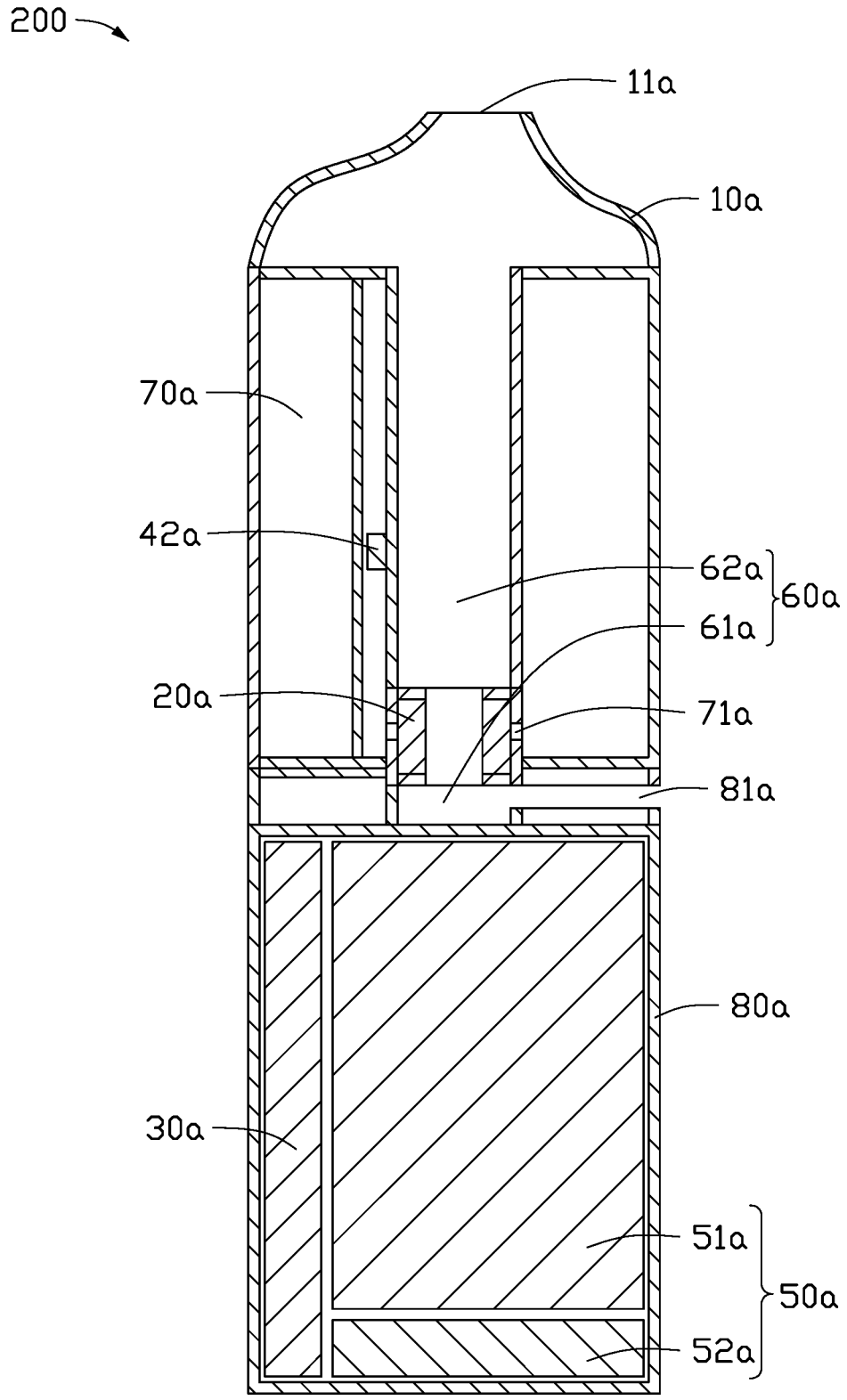
FIG. 4 is a cross-sectional view of an electronic cigarette according to a second embodiment.

Referring to FIG. 4, in a second embodiment, an electronic cigarette 200 includes a cigarette holder 10*a*, a heating member 20*a*, a controller 30*a*, a sensor 42*a*, a battery assembly 50*a*, an airflow passage 60*a*, a storage member 70*a* storing a smoke liquid, and a housing 80*a*. The cigarette holder 10*a* has two ends. One end of the cigarette holder 10*a* defines an air suction port 11*a*, the other end of the cigarette holder 10*a* is coupled to the housing 80*a*. The heating member 20*a*, the controller 30*a*, the sensor 42*a*, the battery assembly 50*a*, the airflow passage 60*a*, and the storage member 70*a* are received in the housing 80*a*. The heating member 20*a*, the sensor 42*a*, and the battery assembly 50*a* are electrically connected with the controller 30*a*. The housing 80*a* defines an air inlet 81*a*. The airflow passage 60*a* is in air communication with the air suction port 11*a* and the air inlet 81*a*. The heating member 20*a* is arranged in the airflow passage 60*a*, and is in liquid communication with the storage member 70*a*. The airflow passage 60*a* has a passage wall. The passage wall of the airflow passage 60*a* is at least partially made of a flexible material, to form an elastic portion. The sensor 42*a* is arranged on the elastic portion and located outside of the airflow passage 60*a*.

When the user inhales through the air suction port 11*a*, an air pressure within the airflow passage 60*a* decreases, and the elastic portion deforms. Thus, the sensor 42*a* may sense the deformation, and generate a trigger signal and send the trigger signal to the controller 30*a*. The controller 30*a* receives the trigger signal, and controls the battery assembly 50*a* to supply an electrical power to the heating member 20*a*. A wall of the storage member 70*a* defines a liquid inlet hole 71*a* aligned with the heating member 20*a*. The smoke liquid stored in the storage member 70*a* flows to the heating member 20*a* through the liquid inlet hole 71*a*. The heating member 20*a* heats the smoke liquid to create smoke. Air from outside flows into the airflow passage 60*a* through the air inlet 81*a*, then mixes with the smoke, and finally flows out from the air suction port 11*a*.

When the user stops inhaling through the air suction port 11*a*, the airflow passage 60*a* is in air communication with the air outside of the electronic cigarette 200 through the air suction port 11*a*. The air pressure in the airflow passage 60*a* is restored and the deformation of the elastic portion is discontinued. Thus, the sensor 42*a* can sense the restoration of the elastic portion, and generates a shutdown signal to the controller 30*a*. The controller 30*a* receives the shutdown signal, and controls the battery assembly 50*a* to stop supplying the electrical power to the heating member 20*a*.

The sensor 42*a* may be a strain gauge type transducer or a capacitive type transducer.

In one embodiment, the airflow passage 60*a* is substantially L-shaped. The airflow passage 60*a* includes an air inlet part 61*a* and a smoke outlet part 62*a*. The air inlet part 61*a* is arranged radially from the lengthways axis of the electronic cigarette 200, and the smoke outlet part 62*a* is arranged along the lengthways axis. The heating member 20*a* is a hollow and open-ended structure. The hollow structure communicates between the air inlet part 61*a* and the smoke outlet part 62*a*. One end of the air inlet part 61*a* opposite to the smoke outlet part 62*a* is in air communication with the air inlet 81*a*. One end of the smoke outlet part 62*a* opposite to the air inlet part 61*a* is in air communication with the air suction port 11*a*. The smoke outlet part 62*a* is a hollow and open-ended tube. The smoke outlet part 62*a* is made of a flexible material. The sensor 42*a* is arranged outside of the wall of the hollow tube.

The battery assembly 50*a* includes a battery module 51*a* and a charging module 52*a*. The controller 30*a* and the charging module 52*a* are electrically connected the battery module 51*a*. The battery module 51*a* is configured to supply the electric power to the heating member 20*a* under the control of the controller 30*a*. The charging module 52*a* is configured to couple to an external power source, to allow the external power source to charge the battery module 51*a*.

In this embodiment, the sensor 42*a* of the electronic cigarette 200 is arranged outside of the airflow passage 60*a*, to sense inhalations of the user by sensing the deformation of the elastic portion of the airflow passage 60*a*. By not arranging the sensor 42*a* in the airflow passage 60*a*, the service life of the sensor 42*a* is prolonged due to a less humid environment, and also the likelihood of the sensor 42*a* being short-circuited caused by the leakage of the smoke liquid is reduced.

Figure 5:
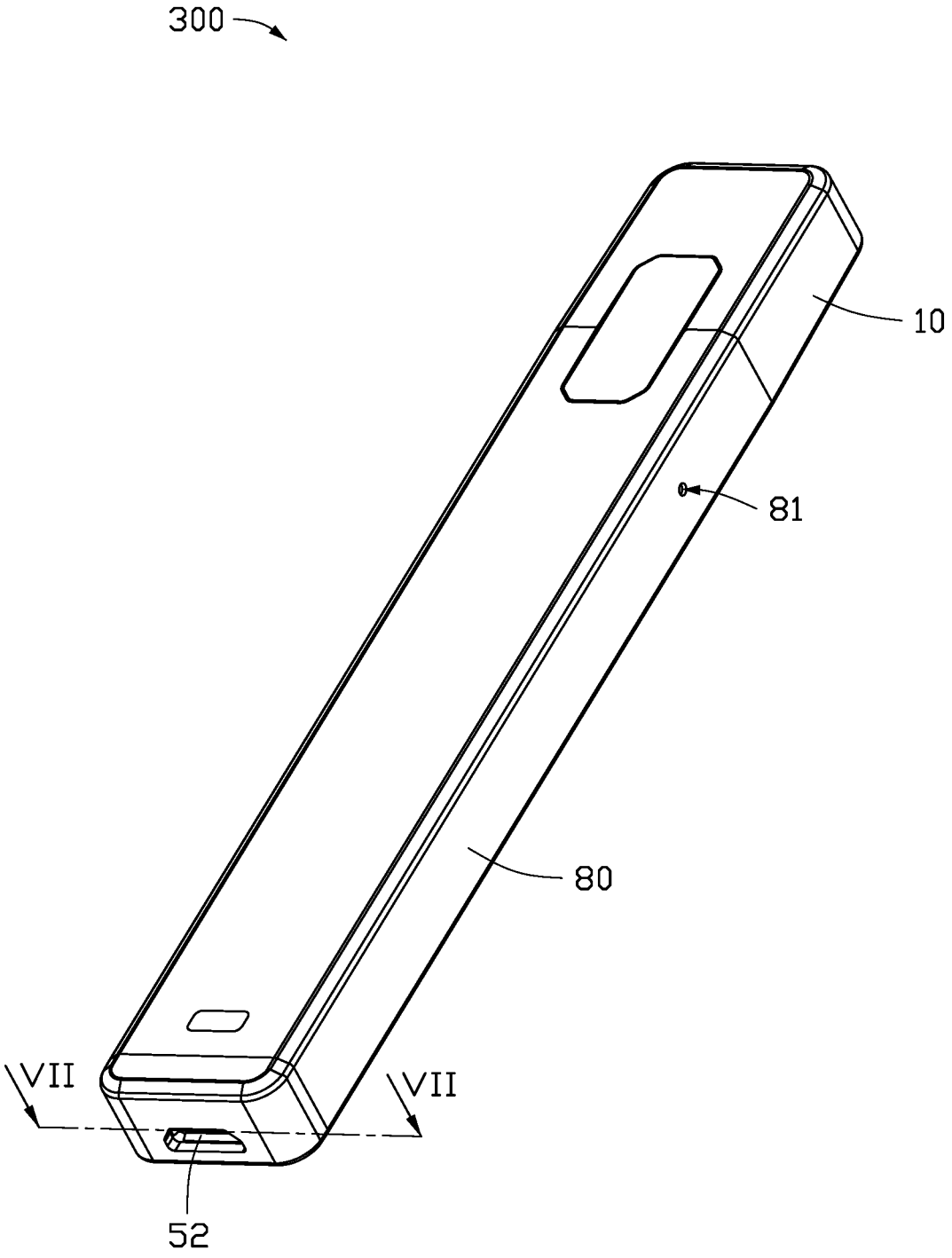
FIG. 5 is a stereoscopic view of an electronic cigarette according to a third embodiment.
Figure 6:
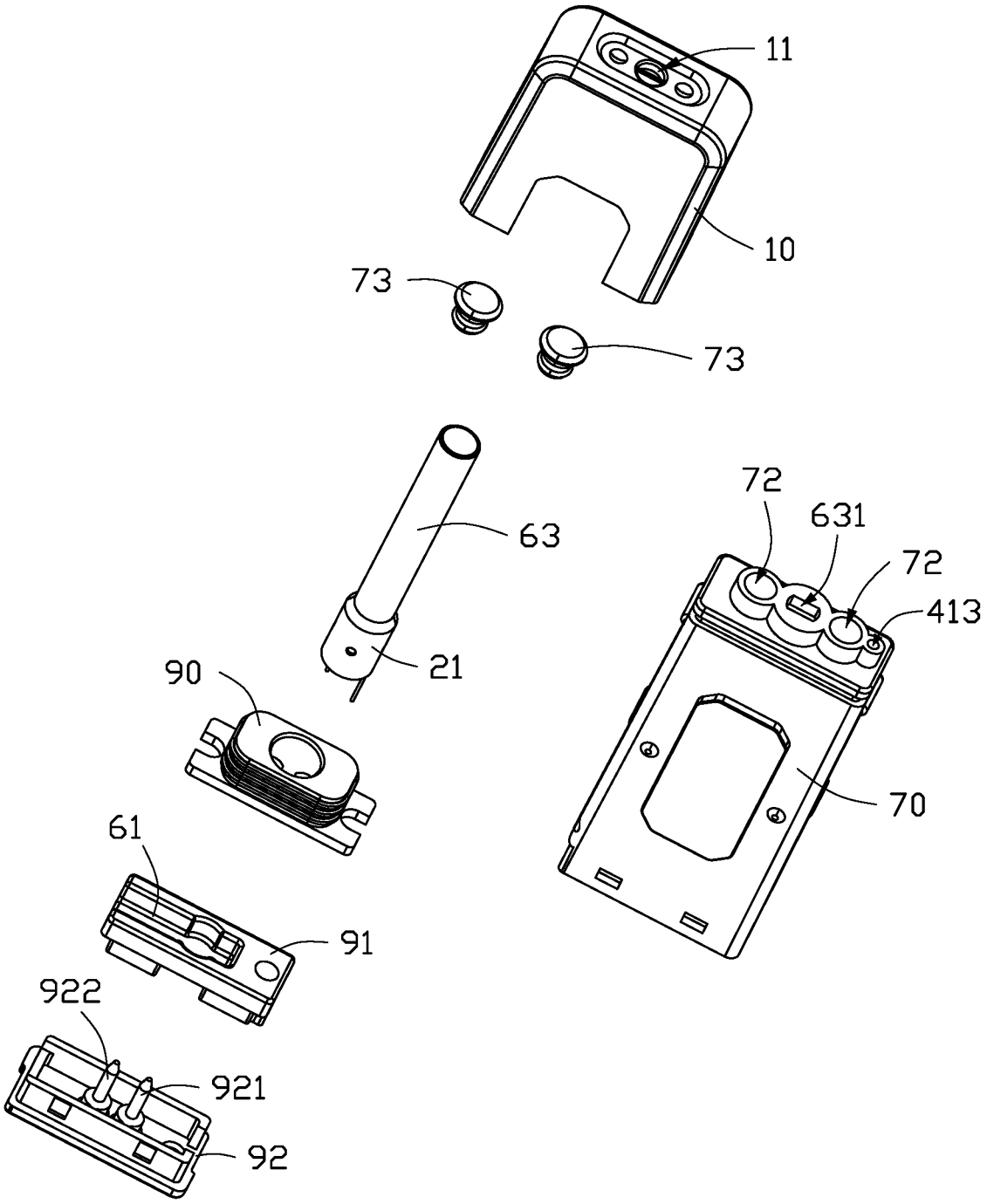
FIG. 6 is an exploded view of a part of the electronic cigarette shown in FIG. 5.
Figure 7:
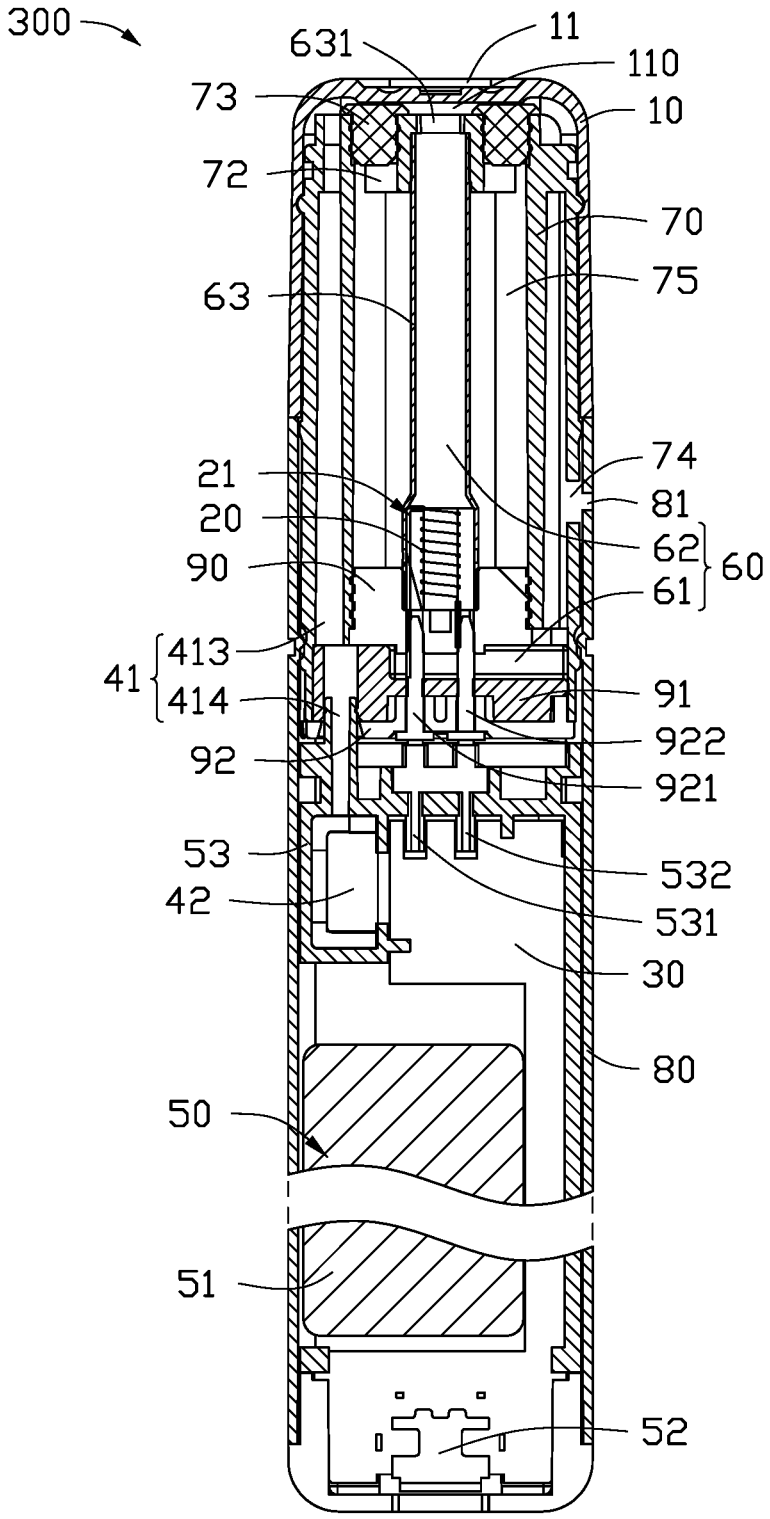
FIG. 7 is a cross-sectional view of the electronic cigarette shown in FIG. 5.

FIGS. 5-7 show an electronic cigarette 300 of a third embodiment. The electronic cigarette 300 includes an atomizer (not labeled in FIGS. 5-7) and a battery assembly 50 electrically connected with the atomizer. When the electronic cigarette 300 is at work, the battery assembly 50 supplies power to the atomizer, so that the liquid tobacco can be heated by the atomizer to generate smoke for a user.

The atomizer includes a storage member 70, a cigarette holder 10 coupled to an end of the storage member 70, a base 90 coupled to an opposite end of the storage member 70, and an atomizing head 21 received in the storage member 70.

The storage member 70 is substantially a hollow structure defining an opening at the lower end thereof. A liquid storage chamber 75 configured to store liquid tobacco is defined in the storage member 70. The liquid storage chamber 75 communicates with the opened end of the lower end of the storage member 70. The base 90 is arranged at the lower end of the storage member 70, and seal the opened end of the storage member 70, to prevent from leaking the liquid tobacco. The atomizing head 21 is received in the liquid storage chamber 75, and the lower end of the atomizing head 21 is connected to the base 90.

Additionally, the atomizer further includes a smoke outlet tube 63 received in the liquid storage chamber 75. A smoke outlet hole 631 is defined on the upper end of the storage member 70. The upper end of the smoke outlet tube 63 connects to the top wall of the storage member 70, and then communicates with the smoke outlet hole 631. At least a part of the atomizing head 21 is received in the smoke outlet tube 63, and an inner cavity of the atomizing head 21 communicates with the smoke outlet tube 63. In the third embodiment, at least a part of the atomizing head 21 is received in the smoke outlet tube 63. An inner cavity of the smoke outlet tube 63 forms a smoke outlet part 62. One end of the smoke outlet part 62 communicates with the smoke outlet hole 631, and another end of the smoke outlet part 62 communicates with the atomizing head 21. In other embodiments, a part of the atomizing head 21 can be received in the liquid storage chamber 75 or positioned at the outside of the liquid storage chamber 75. Accordingly, the smoke outlet tube 63 is positioned at a side of the liquid storage chamber 75 and received in the storage member 70. If the liquid tobacco in the liquid storage chamber 75 can flow into the atomizing head 21, and the two ends of the smoke outlet part 62 are respectively communicated with the smoke outlet hole 631 and the atomizing head 21, the location or structure of the smoke outlet tube 63 is not limited.

Two liquid injecting holes 72 are defined on the top wall of the storage member 70, and the liquid injecting holes 72 are respectively located at two sides of the smoke outlet hole 631. The user can inject liquid tobacco into the liquid storage chamber 75 through the liquid injecting hole 72. In order to prevent liquid tobacco from leaking via the liquid injecting holes 72, each liquid injecting hole 72 is coupled with a sealing members 73. In the operation of injecting liquid tobacco, the cigarette holder 10 and the sealing members 73 are taken off in order, and only one of the injecting holes 72 is used to inject liquid tobacco into the liquid storage chamber 75, and another injecting hole 72 keeps to communicate with the outside. Therefore, during injecting liquid tobacco through one of the injecting holes 72, the air in the liquid storage chamber 75 can be discharged from the other injecting hole 72. The pressure difference between internal and external of the liquid storage chamber 75 can be constant, and the speed of the injecting liquid tobacco passing through the liquid injecting hole 72 can be guaranteed, which is convenient for the liquid injection operation. The sealing member 73 can be made of silicone or rubber. When the number of liquid injecting hole 72 is at least two, during injecting liquid tobacco through one of the injecting holes 72, at least one other liquid injecting hole 72 can communicate with the outside. In other embodiments, the liquid injecting hole 72 can be one. In the third embodiment, the volume of the electronic cigarette 300 is small, if only one liquid injecting hole 72 is defined, the air in the liquid storage chamber 75 will be hard to be discharged, and the operation of liquid injection will be inconvenient. At least two liquid injecting holes 72 can solve problems of liquid injecting and air discharging, thus the operation of liquid injection is more convenient.

In the third embodiment, atomizing head 21 includes a heating member 20 and a liquid absorbing member (not labeled in figures) contacting with each other. The liquid absorbing member communicates to the liquid storage chamber 75, so that the liquid tobacco in the liquid storage chamber 75 can enter into the atomizing head 21 and contact the heating member 20. During using the electronic cigarette 300, the battery assembly 50 supplies power to the heating member 20, and the heating member 20 generates heat to atomize the liquid tobacco to generate smoke. The specific structure of the atomizing head 21 is not limited in the third embodiment, the atomizing head 21 only needs to satisfy the function of atomizing liquid tobacco into smoke. For example, in other embodiments, the heating member 20 of the atomizing head 21 can include heating fins, and the liquid absorbing member can be omitted.

Referring to FIG. 5, in the third embodiment, an inductive chamber 41 is defined at a side of the storage member 70. The inductive chamber 41 is configured to generate physical characteristic changes, and conduct the physical characteristic changes to a sensor. The physical characteristic changes include but are not limited to air pressure or air flow. For example, the user creates a negative pressure in the induction chamber 41 by inhaling, and the negative pressure can be transmitted to the sensor and detected by the sensor. In the third embodiment, the inductive chamber 41 includes a first inductive chamber 413. Furthermore, the first inductive chamber 413 is defined on the storage member 70 along the axial direction of the electronic cigarette 300, and positioned at a side of the liquid storage chamber 75. The upper end of the first inductive chamber 413 penetrates the upper end surface of the storage element 70, and the lower end of the first inductive chamber 413 penetrates the lower surface of the storage element 70. In other embodiments, the first inductive chamber 413 can be positioned inside the liquid storage chamber 75. For example, a through tube can be positioned in the liquid storage chamber 75 and along the axial direction of the storage member 70, and the first inductive chamber 413 is formed by the inner cavity of the through tube.

The cigarette holder 10 is substantially a hollow structure with an opening at the lower end thereof. The cigarette holder 10 is sleeved on the upper end of the storage member 70. An air suction port 11 is defined on the cigarette holder 10. A ventilation gap 110 is defined between the lower end surface of the top wall of the cigarette holder 10 and the upper end surface of the storage member 70. The upper end opening of the first sensing chamber 411 communicates with the air suction port 11 through the ventilation gap 110. The smoke outlet hole 631 communicates with the air suction port 11 through the air ventilation gap 110. In the third embodiment, the cigarette holed 10 is latched to the storage member 70. In other embodiments, the cigarette holder 10 can be detachably connected to the storage member 70 by other ways, such as threaded connection or magnetic connection. The air suction port 11 can be formed by one or more holes defined on the cigarette holder 10.

The battery assembly 50 includes a battery module 51 and a charging module 52. The electronic cigarette 300 further includes a housing 80 and a controller 30. The battery module 51, the charging module 52, and the controller 30 are received in the housing 80. The controller 30 and the charging module 52 are electrically connected with the battery module 51. The controller 30 controls the battery module 51 supply power to the heating member 20. The charging module 52 is configured to connect an external power source, so that the battery module 51 can be charged by the external power source. In the third embodiment, the controller 30 and the charging module 52 are respectively positioned at two ends of the battery module 51. In other embodiments, the location of the controller 30 and the charging module 52 are not limited.

In the third embodiment, at least a part of the storage member 70 is received in the housing 80. That is, at least a part of the atomizer is received in the housing 80. In other embodiments, the atomizer can be positioned at the outside of the housing 80. The atomizer further includes a lining member 91. The lining member 91 is positioned at the lower end of the storage member 70, and under the base 90. The upper end surface of the lining member 91 abuts against the base 90, so that the base 90 is fixed. The upper end surface of the lining member 91 defines a groove. A cavity is defined between the groove and the lower end surface of the base 90, and the cavity forms an air inlet part 61. An air inlet 81 communicating with the outside is defined on the housing 80. An end of the air inlet part 61 communicates with the air inlet 81, another end of the air inlet part 61 communicates with an end of the smoke outlet part 62 away from the air suction port 11. The air inlet part 61 and the smoke outlet part 62 form an airflow passage 60, so that the atomizing head 21 is located in the airflow passage 60, and the airflow passage 60 communicates with the air suction port 11. When the user inhales the electronic cigarette 300, external air enters the airflow passage 60 through the air inlet 81, and when the external air passes through the inside of the atomizing head 21, the smoke is taken out and eventually enters the user mouth through the air suction port 11 of the cigarette holder 10.

Furthermore, a cavity (not labeled in figures) with an opening at the lower end is defined at the lower end surface of the storage member 70 along the axial direction of the storage member 70. The cavity communicates with the air inlet part 61 through the lower end opening. An air inlet port 74 communicating with the cavity and the air inlet 81 is defined on the sidewall of the storage member 70, so that the external air can flow into the airflow passage 60 through the air inlet 81. That is, the external air can enter the electronic cigarette 300 through the storage member 70. The lining member 91 and the base 90 can be made of but not limited to plastic, rubber or other materials capable of sealing the tobacco oil.

The battery assembly 50 further includes a connecting member 53 received in the housing 80. The atomizer connects with the battery assembly 50 via the connecting member 53. Specifically, the connecting member 53 is positioned at the lower end of the storage member 70. An electrode (not labeled in figures) is attached to the connecting member 53. The electrode includes a first electrode 531 and a second electrode 532. One of the first electrode 531 and the second electrode 532 is connected with a positive pole of the battery assembly 51, and another one of the first electrode 531 and the second electrode 532 is connected with a negative pole of the battery assembly 51.

Additionally, the atomizer further includes a base cover 92, a first pole 921, and a second pole 922. The base cover 92 is positioned at the lower end of the storage member 70, and the base cover 92 is under the lining member 91. The first pole 921 corresponds to the first electrode 531, and the second pole 922 corresponds to the second electrode 532. Specifically, the upper end of the first pole 921 sequentially passes through the base cover 92, the lining member 91, and the base 90, and then contacts with an end of the heating member 20 and is electrically connected to the heating member 20. The upper end of the second pole 922 sequentially passes through the base cover 92, the lining member 91, and the base 90, and then contacts with another end of the heating member 20 and is electrically connected to the heating member 20. The lower ends of the first pole 921 and the lower end of the second pole 922 are positioned at the external of the base cover 92. When the lower end of the atomizer is plugged in the housing 80, the first electrode 531 is contacted and electrically connected to the first pole 921. The second electrode 532 is contacted and electrically connected to the second pole 922. Thus the battery module 51 can supply power to the heating member 20.

In the third embodiment, a second inductive chamber 414 is positioned in the connecting member 53. The lower end of the second inductive chamber 414 is closed, and the upper end of the second inductive chamber 414 communicates with the upper end surface of the connecting member 53. That is, the lower end of the second inductive chamber 414 is a closed end, and the upper end is an opened end. When the atomizer is assembled, the first inductive chamber 413 communicates with the second inductive chamber 421. Furthermore, a through hole (not labeled in figures) is defined on the lining member 91, and the lower end of the first inductive chamber 413 communicates with the upper end of the second inductive chamber 414 via the through hole. The inductive chamber 41 with a closed lower end and an opening upper end is formed by the first inductive chamber 413 and the second inductive chamber 414, so that the opened end of the inductive chamber 41 communicates with the air suction port 11.

The electronic cigarette of the present disclosure further includes a sensor 42. The sensor 42 is positioned in the inductive chamber 41, and configured to detect an air pressure signal in the inductive chamber 41. The sensor 42 is in wireless connection with the controller 30. In the third embodiment, the sensor 42 is positioned in the second inductive chamber 414. In other embodiments, the sensor 42 can be positioned in the first inductive chamber 413, and connected with the battery assembly 50 via other electronic elements.

When the user inhales through the air suction port 11, the air in the inductive chamber 41 is at least partially sucked, and the air pressure in the inductive chamber 41 is reduced. The sensor 42 detects the air pressure change, and generates and sends a trigger signal to the controller. The controller 30 receives the trigger signal and controls the battery assembly 50 to provide power to the heating member 20.

When the user stops inhaling and removes the mouth from the air suction port 11, the inductive chamber 41 communicates with the outside through the air suction port 11, so that the air pressure in the inductive chamber 41 is recovered. The sensor 42 detects the recovered air pressure and generates a shutdown signal. The shutdown signal is sent to the controller 30 by the sensor 42. The controller 30 receives the shutdown signal and controls the battery assembly 50 to stop providing power to the heating member 20.

In other embodiments, except for the air suction port 11, other opened ends can be defined and configured to let the inductive chamber 41 communicate with the outside. For example, the charging module 52 includes an USB port. The USB port can be configured for charging the battery module 51, and configured as an external air inlet port for the inductive chamber 41. The sensor 42 is positioned at the inner wall of the inductive chamber 41. When the user inhales, the air enters the airflow passage 60, and enters the inductive chamber 41 through the USB port. The sensor 42 detects the air pressure change in the inductive chamber 41, and sends the trigger signal to the controller 30. The controller 30 controls the battery assembly 50 to provide power to the heating member 20. The sensor 42 further can be an air flow sensor or air pressure sensor, which is configured to detect air flow changes in the inductive chamber 41.

In other embodiments, the inductive chamber 41 is positioned in the storage member 70 as the first embodiment. The lower end of the inductive chamber 41 is closed, and the upper end of the inductive chamber 41 passes through the upper end surface of the storage member 70. Alternatively, the passage wall of the airflow passage 60 is at least partially made of a flexible material to form an elastic portion, as the second embodiment. The sensor 42 is positioned on the elastic portion, and located at the outside of the airflow passage 60. Preferably, the sensor 42 is a resistive strain sensor or a capacitive sensor.

The first inductive chamber 413 of the inductive chamber 41 is positioned at the outside of the liquid storage chamber 75, so that a temperature of the liquid tobacco in the liquid storage chamber 75 will not be greatly reduced due to the external cold air, to avoid affecting atomization. The smoke outlet part 62 of the airflow passage 60 is located in the liquid storage chamber 75. A part of hot smoke flowing from the atomizing head 21 can transfer heat to the liquid tobacco, so that the liquid tobacco is preheated, and the thermal efficiency is improved, and further the atomization efficiency is improved. At the same time, a temperature of smoke at the air suction port 11 is reduced, to prevent from scalding users.

In the third embodiment, an end of the inductive chamber 41 is an opened end, another end of the inductive chamber 41 is a closed end. The opened end of the inductive chamber 41 communicates with the air suction port 11. The sensor 42 is positioned in the inductive chamber 41. The heating member 20 is positioned at the outside of the inductive chamber 41. Therefore, inhaling operations can be directly acted on the sensor 42, without hindrance of the heating member 20. The inductive chamber 41 is separately positioned from the airflow passage 60, which reduces the gas bypass in the inductive chamber 41 and improves the sensitive performance of the sensor 42. On the other hand, detection will not be affected due to the air inlet 81 clogged with leaked liquid tobacco. Additionally, the sensor 42 can be avoided being affected by the wet environment in the airflow passage 60, which may reduce the service life of the sensor 42. The leaked liquid tobacco can also be prevented from causing a short circuit in the sensor 42.

Figure 8:
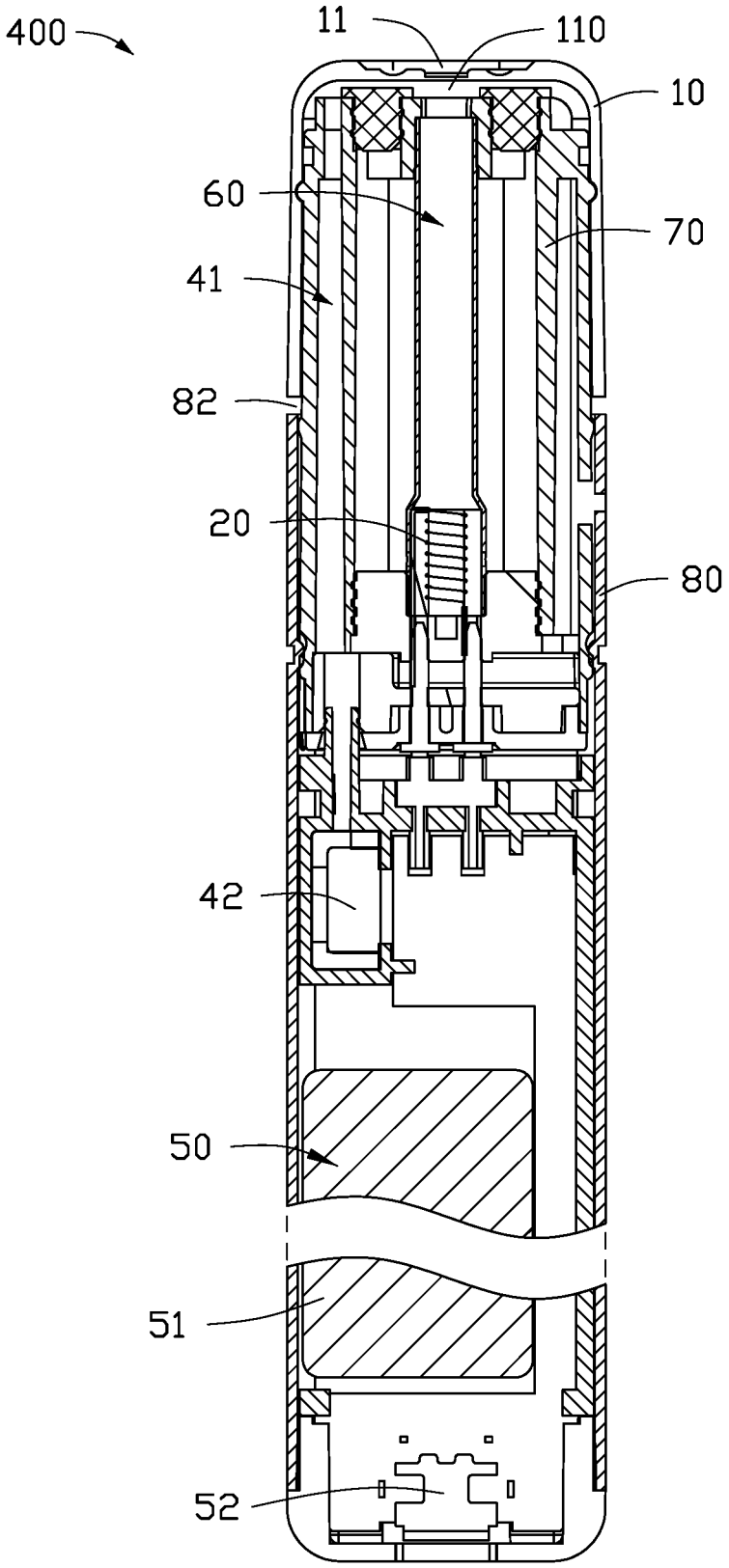
FIG. 8 is a first cross-sectional view of an electronic cigarette in an unlocked state according to a fourth embodiment.
Figure 9:
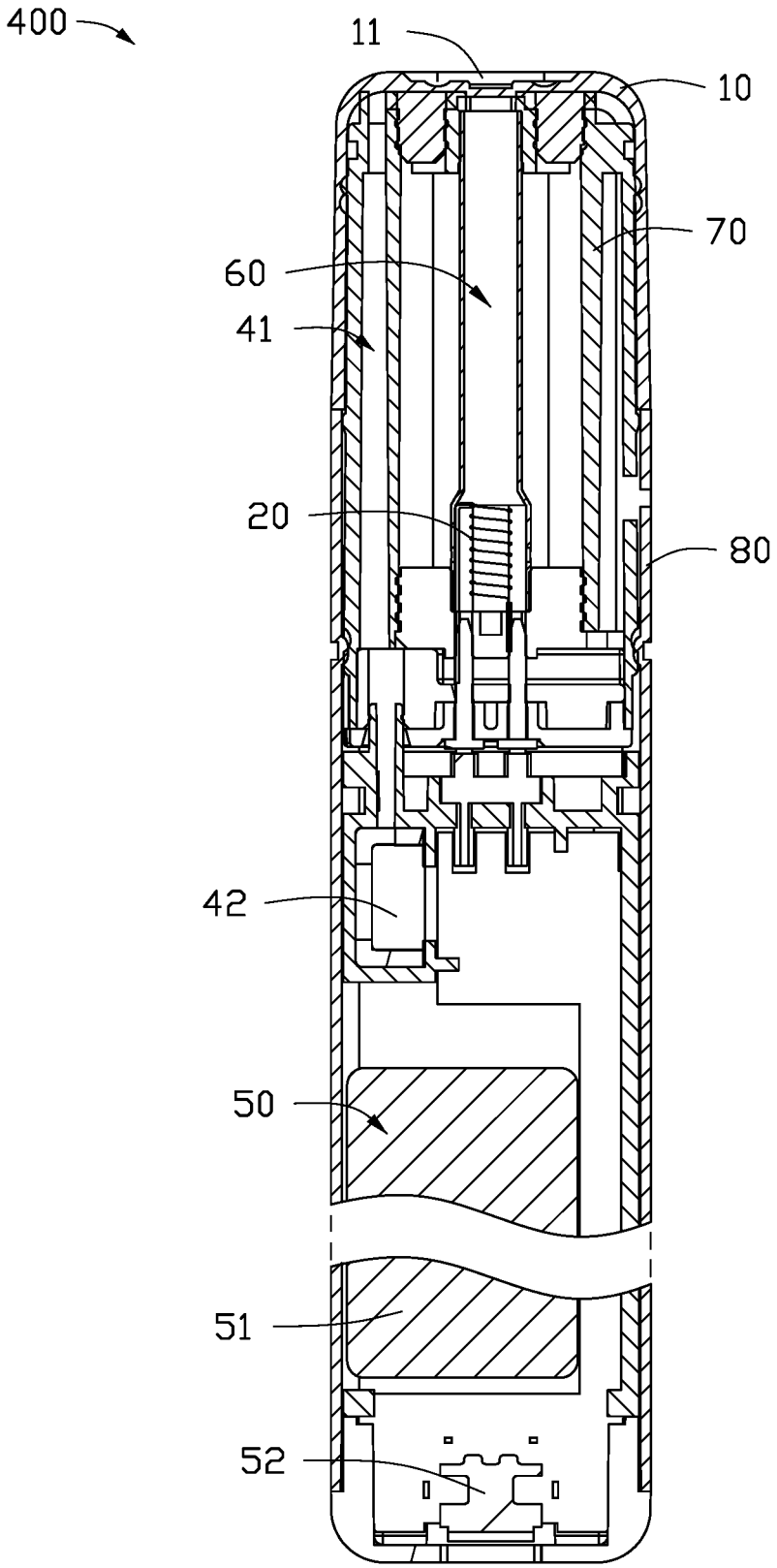
FIG. 9 is a second cross-sectional view of the electronic cigarette in a locked state according to the fourth embodiment.
Figure 10:
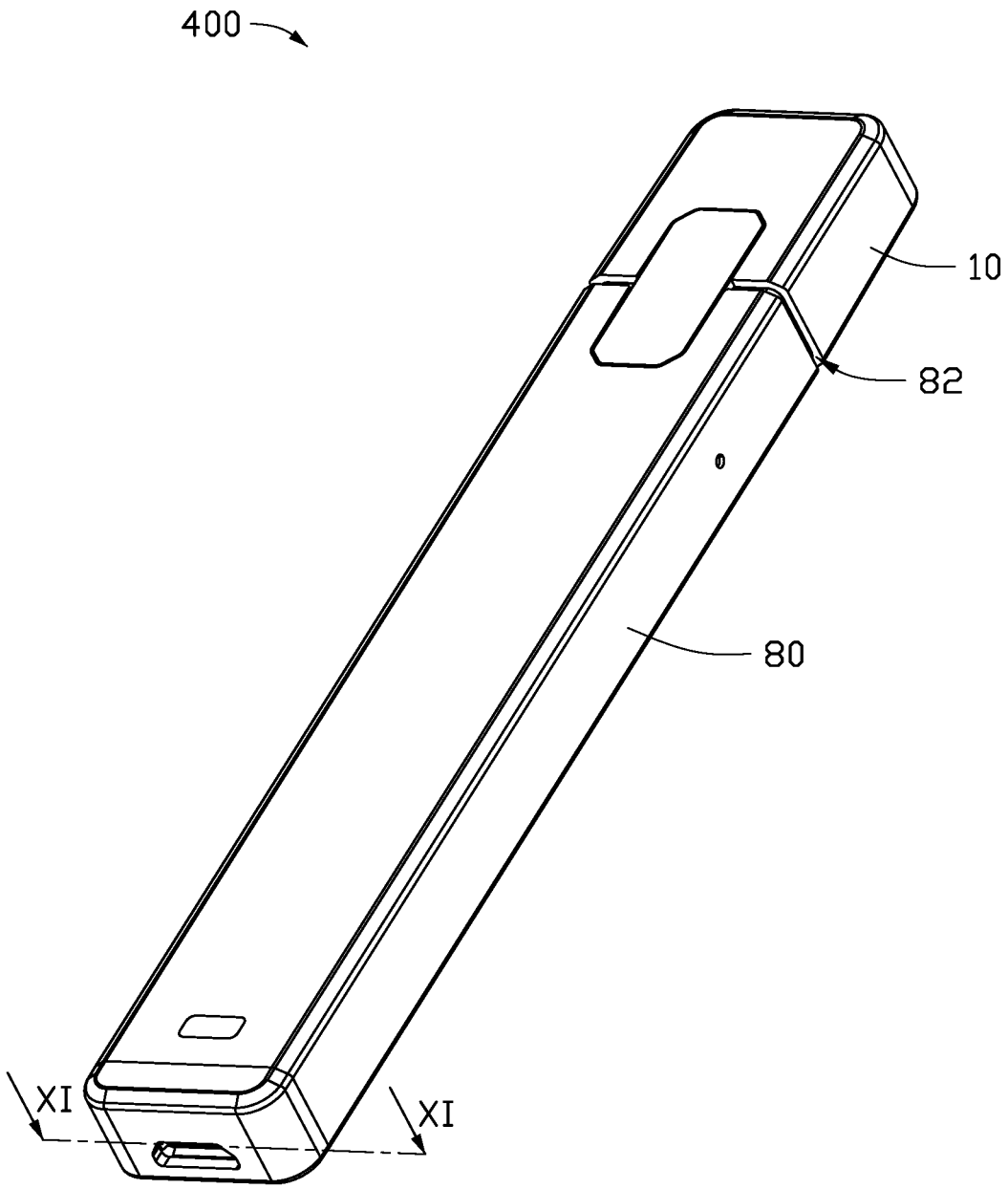
FIG. 10 is a stereoscopic view of the electronic cigarette according to the fourth embodiment.

FIGS. 8-10 show an electronic cigarette 400 of a fourth embodiment. The differences between the electronic cigarette 400 and the electronic cigarette 300 of the third embodiment are illustrated as follows. The cigarette holder 10 is movably sleeved on the upper end of the storage member 70 along the axial direction of the electronic cigarette 400. A fitting relationship between the cigarette holder 10 and the storage member 70 can be switched between a locked relationship and an unlocked relationship by moving the cigarette holder 10. In other words, the cigarette holder 10 can be switched between a locked state and an unlocked state according to the storage member 70. When the cigarette holder 10 is in the locked state, at least one of the inductive chamber 41 and the airflow passage 60 is closed by the cigarette holder 10. When the cigarette holder 10 is in the unlocked state, the air suction port 11 communicates with both of the inductive chamber 41 and the airflow passage 60.

In the fourth embodiment, the air suction port 11, and the air outlet end of the inductive chamber 41 and the airflow passage 60 are staggered. Referring to FIG. 9, when the cigarette holder 10 and the storage member 70 are in the locked relationship, the ventilation gap 110 is not existed between the cigarette holder 10 and the storage member 70. The lower end surface of the top wall of the cigarette holder 10 closes the opened end of the inductive chamber 41 and the airflow passage 60 at the same time. Therefore, the user cannot inhale through the air suction port 11 of the cigarette holder 10. Referring to FIG. 8, when the cigarette holder 10 and the storage member 70 are in the unlocked relationship, the ventilation gap 110 is existed between the cigarette holder 10 and the storage member 70, and the opened end of the inductive chamber 41 and the airflow passage 60 are communicated with the air suction port 11 of the cigarette holder 10 through the ventilation gap 110. Therefore, the user can inhale.

In the fourth embodiment, the user can switch the fitting relationship (locked state and unlocked state) between the cigarette holder 10 and the storage member 70 by pulling or pressing the cigarette holder 10 for a certain distance. In other embodiments, the user can switch the fitting relationship (locked state and unlocked state) between the cigarette holder 10 and the storage member 70 by other methods such as screwing, squeezing, or overturning.

In other embodiments, the air suction port 11 can communicate with only one of the opened end of the inductive chamber 41 and the outlet end of the airflow passage 60. When the cigarette holder 10 and the storage member 70 are in the locked relationship, the cigarette holder 10 closes one of the inductive chamber 41 and the airflow passage 60, and the electronic cigarette is prevented from working. When the cigarette holder 10 and the storage member 70 are in the unlocked relationship, the cigarette holder 10 communicates with the inductive chamber 41 and the airflow passage 60 at the same time. Therefore, in the fourth embodiment, when the user inhales, the cigarette holder 10 needs to be moved to let the cigarette holder 10 and the storage element 70 are in the unlocking relationship, so that the electronic cigarette 400 can perform inhaling operations. T the electronic cigarette 400 has a child-proof function.

Additionally, referring to FIG. 8 and FIG. 10, in the fourth embodiment, when the cigarette holder 10 and the storage member 70 are in the unlocked relationship, a space 82 is defined between the cigarette holder 10 and the housing 80. The space 82 is convenient for the cigarette holder 10 switching states between the unlocked and locked states. When the cigarette holder 10 and the storage member 70 are in the locked state, the cigarette holder 10 abuts against the housing 80 to remind the user that the cigarette holder 10 has been moved into right place.

Figure 11:
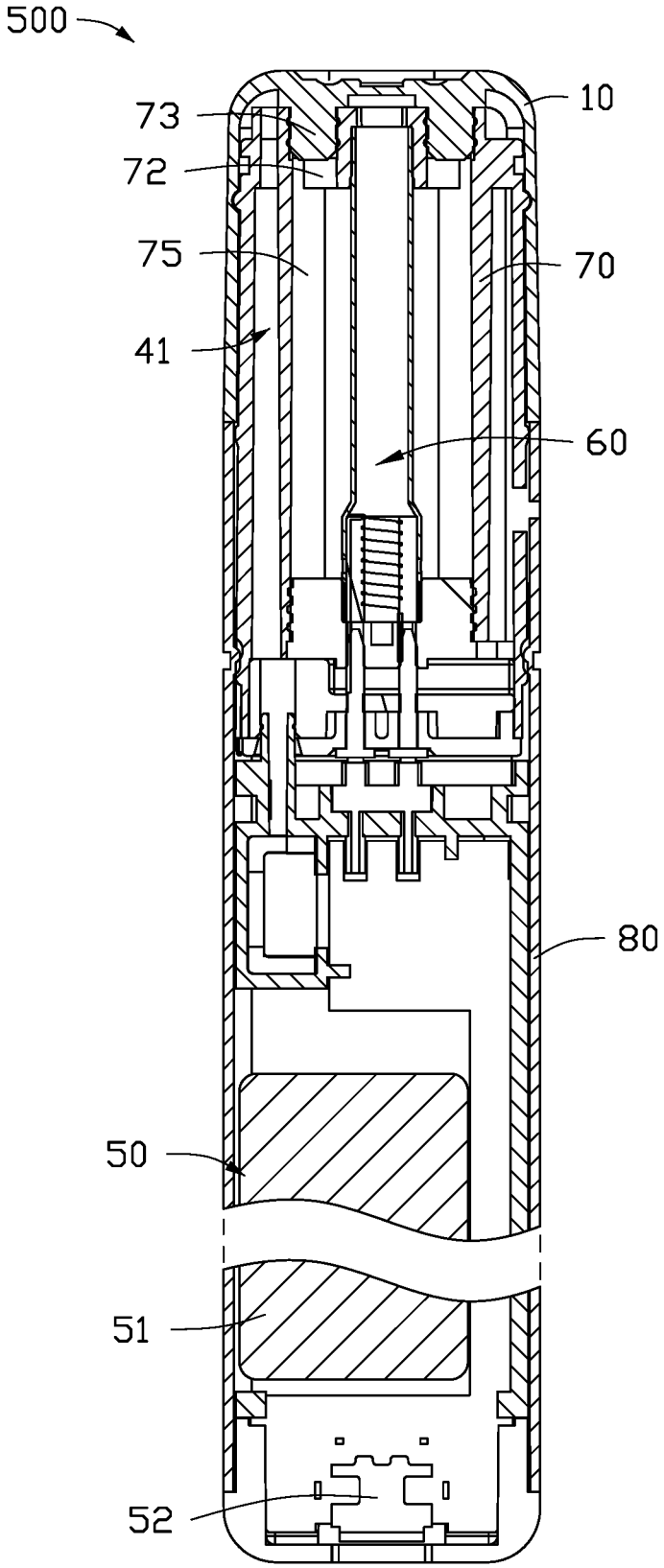
FIG. 11 is a cross-sectional view of an electronic cigarette according to a fifth embodiment.

FIG. 11 shows an electronic cigarette 500 of a fifth embodiment. The differences between the electronic cigarette 500 and the electronic cigarette 300 of the third embodiment are illustrated as follows. A plurality of sealing members 73 of the electronic cigarette 500 are in an integrated body. The sealing members 73 are fixedly connected to the lower end surface of the top wall of the cigarette holder 10. The sealing member 73 and the cigarette holder 10 can be fixedly connected by a glue connection or fasteners, such as bolts and screws. In other embodiments, the sealing member 73 and the cigarette holder 10 can be integrated together. Therefore, when the user needs to inject liquid tobacco into the liquid storage chamber 75, the sealing member 73 is pulled out with the cigarette holder 10 from the liquid injecting hole 72. The structure of the electronic cigarette 500 is simpler and the operation of injecting liquid tobacco is more convenient.

Figure 12:
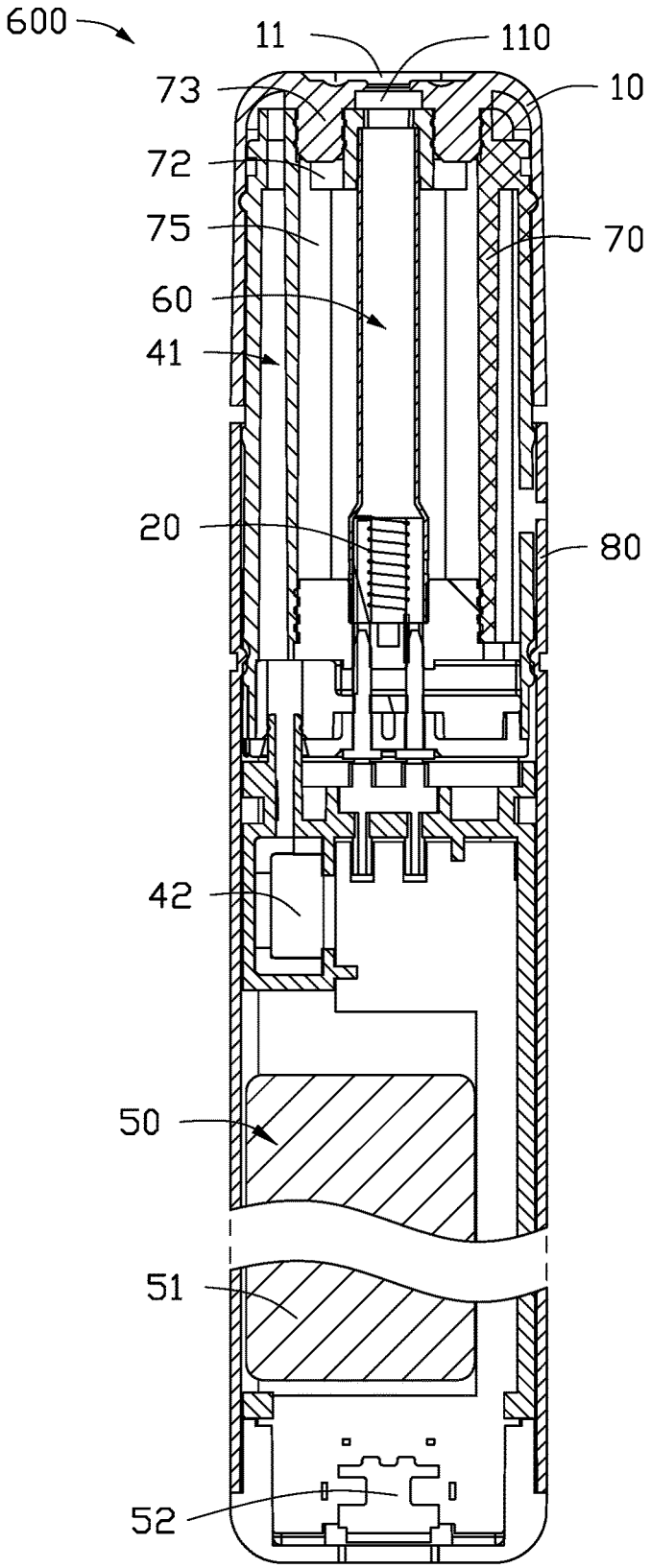
FIG. 12 is a first cross-sectional view of an electronic cigarette in an unlocked state according to a sixth embodiment.
Figure 13:
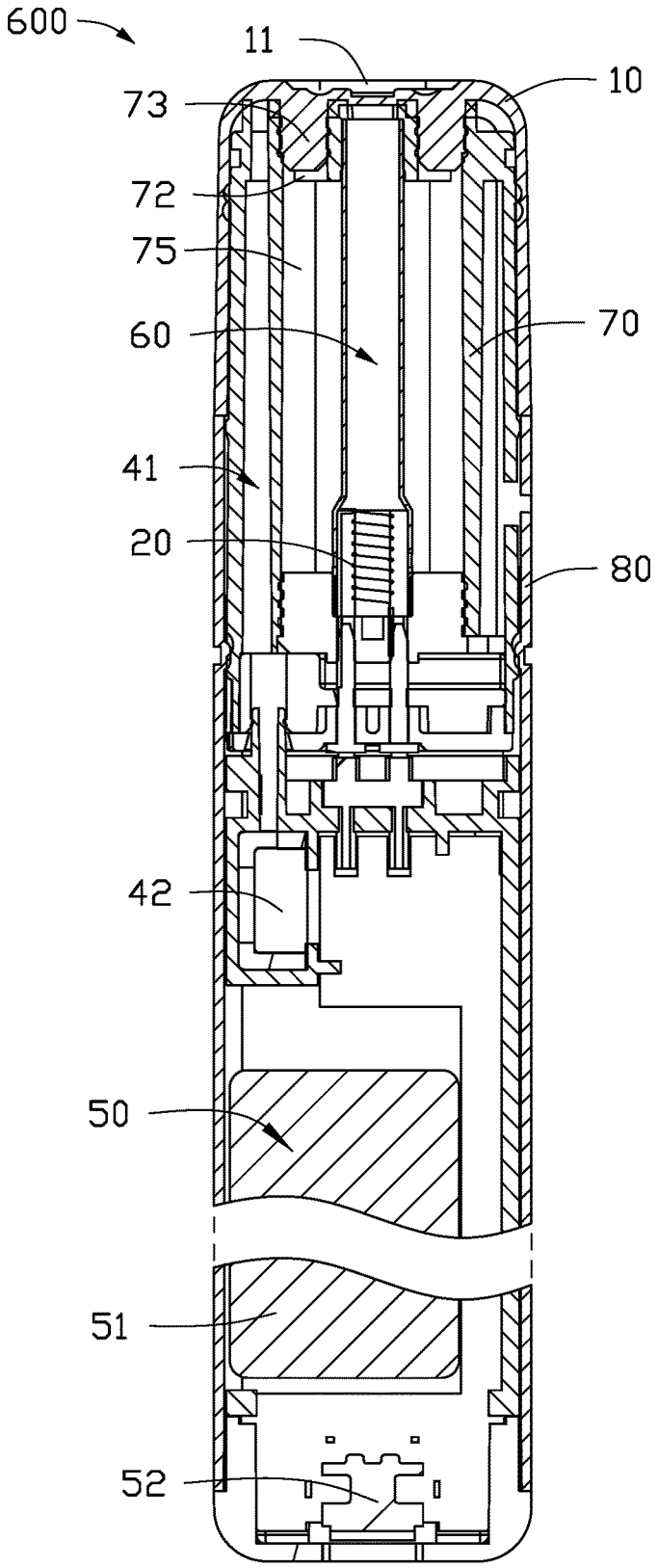
FIG. 13 is a second cross-sectional view of the electronic cigarette in a locked state according to the sixth embodiment.

FIG. 12 and FIG. 13 show an electronic cigarette 600 of a sixth embodiment. The differences between the electronic cigarette 600 and the electronic cigarette 300 of the third embodiment are illustrated as follows. The electronic cigarette 600 combines technical features of the electronic cigarette 400 and the electronic cigarette 500. The cigarette holder 10 is movably sleeved on the upper end of the storage member 70 along the axial direction of the electronic cigarette 600. A fitting relationship between the cigarette holder 10 and the storage member 70 can be switched between a locked relationship and an unlocked relationship by moving the cigarette holder 10. A plurality of sealing members 73 are in an integrated body, and the sealing member 73 is fixedly connected to the lower end surface of the top wall of the cigarette holder 10. Specific working processes are same as the fourth embodiment and the fifth embodiment. During switching the fitting relationship between the cigarette holder 10 and the storage member 70, the sealing member 73 always closes the liquid injecting hole 72. Only when the user needs to inject liquid and pull out the cigarette holder 10, the sealing member 73 can be pulled out of the liquid inlet 72 with the cigarette holder 10. The electronic cigarette 600 has a child-proof function, and the structure of the electronic cigarette 600 is simplified, so that the operation of injecting liquid tobacco is more convenient.

The embodiments shown and described above are only examples. Many details are often found in the art such as the other features of an electronic cigarette. Therefore, many such details are neither shown nor described. Even though numerous characteristics and advantages of the embodiments have been set forth in the foregoing description, together with details of the structure and function of the embodiments, the present disclosure is illustrative only, and changes may be made in details, including in the matters of shape, size, and arrangement of parts within the principles of the embodiments to the full extent indicated by the broad general meaning of the terms in which the appended claims are expressed.

What is claimed is:

1. An atomizer, comprising:

a storage member defined a liquid storage chamber;

wherein the liquid storage chamber is configured for storing liquid tobacco, at least two liquid injecting holes are defined on the storage member and in communication with the liquid storage chamber, a sealing member is positioned over each of the liquid injection holes, during liquid injection operation, at least one of the liquid injection holes provides an air outlet passage from the liquid storage chamber to an exterior of the atomizer, and the liquid storage chamber receives liquid tobacco through other ones of the liquid injection holes.

2. The atomizer of claim 1, further comprising a cigarette holder positioned at a top end of the storage member, wherein the cigarette holder defines an air suction port and covers the at least two liquid injecting holes.

3. The atomizer of claim 2, wherein the cigarette holder is detachably positioned at the top end of the storage member, during liquid injection operation, the cigarette holder and the sealing member are configured to be detached from the storage member.

4. The atomizer of claim 2, further comprising a smoke outlet tube and an atomizing head, wherein the smoke outlet tube and the atomizing head are received in the liquid storage chamber, an upper end of the smoke outlet tube is connected to a top end wall of the storage member, a lower end of the smoke outlet tube is connected to and in communication with the atomizing head, a smoke outlet hole is defined on the top end wall of the storage member, and the smoke outlet hole is in communication with the upper end of the smoke outlet tube and the air suction port.

5. The atomizer of claim 4, wherein the number of the liquid injection holes is two, the two liquid injection holes are respectively located at two sides of the smoke outlet hole.

6. The atomizer of claim 2, wherein an inductive chamber and an airflow passage is separately defined in the storage member.

7. The atomizer of claim 6, wherein the cigarette holder is movably positioned at the top end of the storage member, the cigarette holder is adapted to alternate between a locked state and an unlocked state with respect to the storage member by moving the cigarette holder; when the cigarette holder is in the locked state, at least one of the inductive chamber and the airflow passage is closed by the cigarette holder; when the cigarette holder is in the unlocked state, the air suction port communicates with both of the inductive chamber and the airflow passage.

8. The atomizer of claim 6, wherein the inductive chamber comprises a first inductive chamber, the first inductive chamber is defined in the storage member and positioned at a side of the liquid storage chamber, or defined in the liquid storage chamber, the air suction port communicates both of the first inductive chamber and the airflow passage.

9. The atomizer of claim 8, wherein a ventilation gap is formed between a lower surface of a top end wall of the cigarette holder and an upper surface of a top end wall of the storage member, the airflow passage communicates with the air suction port through the ventilation gap.

10. An electronic cigarette, comprising:

an atomizer comprising:

a storage member defined a liquid storage chamber; and an atomizing head; and a battery assembly electrically connected to the atomizer;

wherein the liquid storage chamber is configured for storing liquid tobacco, at least two liquid injecting holes are defined on the storage member and in communication with the liquid storage chamber, a sealing member is positioned over each of the liquid injection holes, during liquid injection operation, at least one of the liquid injection holes provides an air outlet passage from the liquid storage chamber to an exterior of the atomizer, and the liquid storage chamber receives liquid tobacco through other ones of the liquid injection holes;

wherein when the electronic cigarette is switched on, the battery assembly supplies power to the atomizing head, and the atomizing head heats the liquid tobacco from the liquid storage chamber.

11. The electronic cigarette of claim 10, wherein the atomizer further comprises a cigarette holder positioned at a top end of the storage member, the cigarette holder defines an air suction port and covers the at least two liquid injecting holes.

12. The electronic cigarette of claim 11, wherein the cigarette holder is detachably positioned at the top end of the storage member, during liquid injection operation, the cigarette holder and the sealing members are configured to be detached from the storage member.

13. The electronic cigarette of claim 11, wherein the atomizer further comprises a smoke outlet tube, the smoke outlet tube and the atomizing head are received in the liquid storage chamber, an upper end of the smoke outlet tube is connected to a top end wall of the storage member, a lower end of the smoke outlet tube is connected to and in communication with the atomizing head, a smoke outlet hole is defined on the top end wall of the storage member, and the smoke outlet hole is in communication with the upper end of the smoke outlet tube and the air suction port.

14. The electronic cigarette of claim 13, wherein the number of the liquid injection holes is two, the two liquid injection holes are respectively located at two sides of the smoke outlet hole.

15. The electronic cigarette of claim 11, wherein an inductive chamber and an airflow passage is separately defined in the storage member.

16. The electronic cigarette of claim 15, wherein the cigarette holder is movably positioned at the top end of the storage member, the cigarette holder is adapted to alternate between a locked state and an unlocked state with respect to the storage member by moving the cigarette holder; when the cigarette holder is in the locked state, at least one of the inductive chamber and the airflow passage is closed by the cigarette holder; when the cigarette holder is in the unlocked state, the air suction port communicates with both of the inductive chamber and the airflow passage.

17. The electronic cigarette of claim 15, wherein the inductive chamber comprises a first inductive chamber, the first inductive chamber is defined in the storage member and positioned at a side of the liquid storage chamber, or defined in the liquid storage chamber, the air suction port communicates both of the first inductive chamber and the airflow passage.

18. The electronic cigarette of claim 17, wherein a ventilation gap is formed between a lower surface of a top end wall of the cigarette holder and an upper surface of a top end wall of the storage member, the airflow passage communicates with the air suction port through the ventilation gap.

* * * * *